US009598943B2

(12) United States Patent
Hughes et al.

(10) Patent No.: US 9,598,943 B2
(45) Date of Patent: Mar. 21, 2017

(54) DISTRIBUTED LIFT SYSTEMS FOR OIL AND GAS EXTRACTION

(71) Applicant: GE Oil & Gas ESP, Inc., Oklahoma City, OK (US)

(72) Inventors: Michael Franklin Hughes, Oklahoma City, OK (US); Jeremy Daniel Van Dam, Niskayuna, NY (US); Vaibhav Bahadur, Niskayuna, NY (US); Aboel Hassan Muhammed, Niskayuna, NY (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 338 days.

(21) Appl. No.: 14/081,991

(22) Filed: Nov. 15, 2013

(65) Prior Publication Data

US 2015/0136414 A1 May 21, 2015

(51) Int. Cl.

| | |
|---|---|
| ***E21B 43/12*** | (2006.01) |
| ***E21B 43/30*** | (2006.01) |
| *E21B 23/00* | (2006.01) |

(52) U.S. Cl.

CPC ..... *E21B 43/128* (2013.01); *E21B 43/122* (2013.01); *E21B 43/305* (2013.01); *E21B 2023/008* (2013.01)

(58) Field of Classification Search

CPC .... E21B 43/128; E21B 43/305; E21B 43/122; E21B 2023/008; E21B 23/14; E21B 43/12; E21B 43/121; E21B 43/14

See application file for complete search history.

(56) References Cited

U.S. PATENT DOCUMENTS

| | | | | |
|---|---|---|---|---|
| 5,770,271 | A | 6/1998 | Imamura | |
| 6,257,332 | B1 | 7/2001 | Vidrine | |
| 6,325,143 | B1 * | 12/2001 | Scarsdale | E21B 43/128 166/106 |
| 6,557,642 | B2 | 5/2003 | Head | |
| 6,761,233 | B1 | 7/2004 | Aadland | |
| 7,143,843 | B2 | 12/2006 | Doering | |
| 7,325,606 | B1 | 2/2008 | Vail, III | |
| 8,844,636 | B2 | 9/2014 | Bebak | |

(Continued)

FOREIGN PATENT DOCUMENTS

| | | |
|---|---|---|
| WO | 2010016767 A2 | 2/2010 |
| WO | 2013086623 A1 | 6/2013 |

OTHER PUBLICATIONS

PCT Search Report and Written Opinion issued in connection with corresponding PCT Application No. PCT/US2014/063633 on Oct. 5, 2015.

*Primary Examiner* — Brad Harcourt
(74) *Attorney, Agent, or Firm* — Crowe & Dunleavy, P.C.

(57) ABSTRACT

A distributed artificial lift system is configured for use in a wellbore that includes a vertical section and at least one lateral section connected to the vertical section. The distributed artificial lift system includes a first remote assembly positioned within the first lateral section. The first remote assembly includes an equipment deployment vehicle and cargo selected from the group consisting of electric remote pumping units, tubing, tubing connectors, tubing adaptors, sensor packages, gas separators, perforating tools, injection pumps and other downhole components. The first remote assembly is optionally self-propelled and remotely-controlled.

16 Claims, 6 Drawing Sheets

(56) References Cited

U.S. PATENT DOCUMENTS

| | | | | |
|---|---|---|---|---|
| 9,062,503 | B2 | 6/2015 | Lehr | |
| 9,133,673 | B2 | 9/2015 | Hill | |
| 2001/0050173 | A1* | 12/2001 | Head | E21B 17/003 166/381 |
| 2004/0108110 | A1* | 6/2004 | Zupanick | B65G 5/00 166/245 |
| 2004/0134654 | A1 | 7/2004 | Snow | |
| 2005/0217861 | A1 | 10/2005 | Misselbrook | |
| 2006/0042835 | A1 | 3/2006 | Guerrero | |
| 2009/0084543 | A1 | 4/2009 | Fitzgerald | |
| 2009/0271117 | A1* | 10/2009 | Ayoub | E21B 41/0035 702/11 |
| 2009/0277628 | A1 | 11/2009 | Watson | |
| 2010/0139388 | A1 | 6/2010 | Griffiths | |
| 2010/0263856 | A1 | 10/2010 | Lynde | |
| 2010/0314103 | A1 | 12/2010 | Crossley | |
| 2011/0051297 | A1 | 3/2011 | Knox | |
| 2012/0012333 | A1* | 1/2012 | Quigley | E21B 43/128 166/369 |
| 2013/0025852 | A1 | 1/2013 | Edmonstone | |
| 2013/0180730 | A1 | 7/2013 | Bebak et al. | |
| 2013/0333970 | A1 | 12/2013 | Heieie | |
| 2014/0341755 | A1* | 11/2014 | Laing | E21B 43/121 417/53 |

* cited by examiner

DISTRIBUTED LIFT SYSTEMS FOR OIL AND GAS EXTRACTION

FIELD OF THE INVENTION

This invention relates generally to the field of downhole pumping systems, and more particularly to systems used for optimizing the recovery of petroleum products from deviated wellbores.

BACKGROUND

Submersible pumping systems are often deployed into wells to recover petroleum fluids from subterranean reservoirs. As noted in the PRIOR ART drawing of FIG. 1, a submersible pumping system 200 includes a number of components, including an electric motor 202 coupled to one or more pump assemblies 204. Production tubing 206 is connected to the pump assemblies to deliver the wellbore fluids from the subterranean reservoir to a storage facility on the surface.

With advancements in drilling technology, it is now possible to accurately drill wells with multiple horizontal deviations. Horizontal wells are particularly prevalent in unconventional shale plays, where vertical depths may range up to about 10,000 feet with lateral sections extending up to 8,000 feet. As illustrated in FIG. 1, it can be difficult or impossible to deploy a conventional electric submersible pump (ESP) in these highly deviated wells. The pumping system 200 is installed in a vertical section 208*a* of the well 208 at some distance from the lateral section 208*b*. The prior art placement of the pumping system 200 in the vertical section 208*a* frustrates the recovery of petroleum products from the deeper lateral section 208*b*.

Because lateral sections of the wellbore are drilled to follow the production zone of the reservoir, the lateral sections may include vertical undulations (as illustrated in FIG. 1). The lower sections of the lateral 208*b* may trap solids and fluids and the high sections trap gas and inhibit movement of fluids through the well. Once the gas in the trap reaches a certain pressure, it will rapidly release through the wellbore causing what is known as a "gas blow out," which is more technically classified as terrain slugging. Terrain slugging tends to be inconsistent and indeterminate and disrupts well production. The large pockets of gas can cause the pumping system 200 to stop producing and overheat.

Additionally, the inability to remove fluids from the deepest portions of the lateral sections of the well may increase the static pressures applied through the vertical fluid column and reduce flow from reservoir. Accordingly, there is therefore a continued need for an improved system that more effectively produces petroleum products from deviated wellbores. It is to these and other deficiencies in the prior art that the present invention is directed.

SUMMARY OF THE INVENTION

In a first aspect, the preferred embodiments include a distributed artificial lift system for use in a wellbore that includes a vertical section and at least one lateral section connected to the vertical section. The distributed artificial lift system includes a first remote assembly positioned within the first lateral section. The first remote assembly includes an equipment deployment vehicle and cargo selected from the group consisting of electric remote pumping units, tubing, tubing connectors, tubing adaptors, sensor packages, gas separators, perforating tools, injection pumps and other downhole components. The first remote assembly is optionally self-propelled and remotely-controlled.

In another aspect, the preferred embodiments include an electric submersible pumping system for use in recovering fluids from a wellbore. The electric submersible pumping system includes a base assembly that has an electric motor and a pump assembly driven by the electric motor. The electric submersible pumping system further includes a remote assembly spaced apart from the base assembly. The remote assembly includes a remote motor and a remote pump driven by the remote motor.

In yet another aspect, the preferred embodiments include a method for recovering fluids from a subterranean reservoir through a wellbore that itself includes a first vertical section and a first lateral section connected to the first vertical section. The method includes the steps of providing a first remote assembly that includes an equipment deployment vehicle and a remote pump supported by the equipment deployment vehicle. The method continues by lowering the first remote assembly through the first vertical section of the wellbore to the first lateral section. The method then includes the step of driving the equipment deployment vehicle of the first remote assembly to a desired location within the first lateral section. The method then involves activating the remote pump of the first remote assembly to remove fluids from the first lateral section.

DETAILED DESCRIPTION OF THE PREFERRED EMBODIMENT

As used herein, the term "petroleum" refers broadly to all mineral hydrocarbons, such as crude oil, gas and combinations of oil and gas. For the purposes of the disclosure herein, the terms "upstream" and "downstream" shall be used to refer to the relative positions of components or portions of components with respect to the general flow of fluids produced from the wellbore. "Upstream" refers to a position or component that is passed earlier than a "downstream" position or component as fluid is produced from the wellbore. The terms "upstream" and "downstream" are not necessarily dependent on the relative vertical orientation of a component or position. It will be appreciated that many of the components in the following description are substantially cylindrical and have a common longitudinal axis that extends through the center of the elongated cylinder and a radius extending from the longitudinal axis to an outer circumference. Objects and motion may be described in terms of radial positions.

Figure 1:
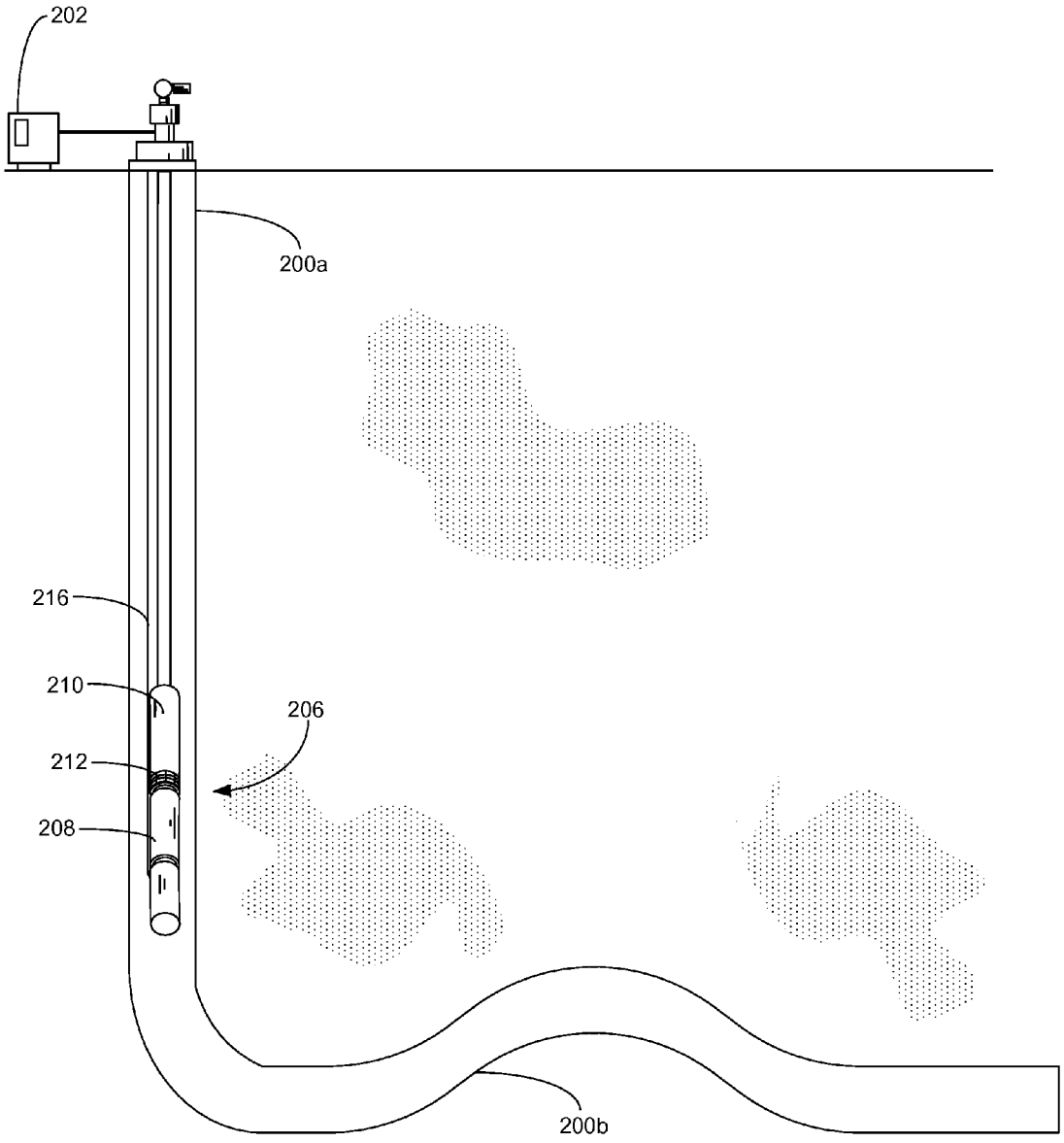
FIG. 1 PRIOR ART
FIG. 1 is an elevational view of PRIOR ART electric submersible pumping system.
Figure 2:
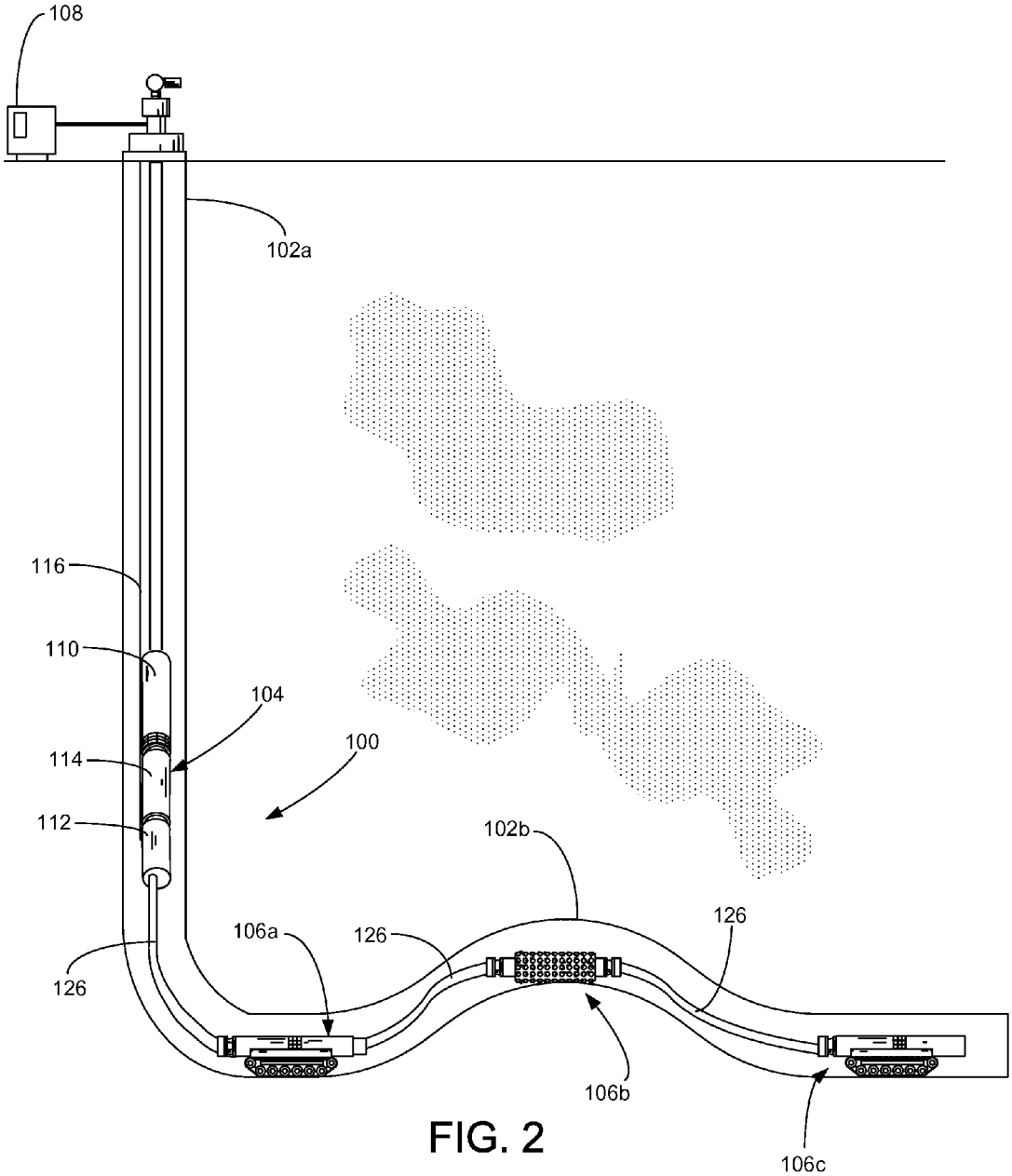
FIG. 2 is an elevational view of an electric submersible pumping system constructed in and deployed in accordance with a first preferred embodiment.

Beginning with FIG. 2, shown therein is an electric submersible pumping system 100 constructed and deployed in accordance with a first preferred embodiment. The electric submersible pumping system 100 is deployed in a wellbore 102 that includes a vertical section 102*a* and a deviated section 102*b*. The deviated section 102*b* of the wellbore 102 includes an undulated profile. The electric submersible pumping system 100 generally includes one or more base assemblies 104, one or more remote assemblies 106 and surface facilities 108.

As depicted in FIG. 2, the electric submersible pumping system 100 includes a single base assembly 104 disposed in the vertical section 102*a* and three remote assemblies 106 disposed in the deviated section 102*b*. It will be further noted that alternate embodiments of the electric submersible pumping system 100 may include only one or more remote assemblies 106 that are connected directly to the surface facilities 108. The surface facilities 108 include controls, variable speed drives and power supplies configured to drive, control and receive data from the base assembly 104 and remote assemblies 106.

The electric submersible pumping system 100 preferably includes a pump assembly 110, a motor assembly 112 and a seal section 114. The seal section 114 shields the motor assembly 112 from mechanical thrust produced by the pump assembly 110 and provides for the expansion of motor lubricants during operation. During use, wellbore fluids are drawn into the pump assembly 110 for delivery to the surface through production tubing 116. Although only one of each component is shown, it will be understood that more can be connected when appropriate. For example, in many applications, it is desirable to use tandem-motor combinations, multiple seal sections and multiple pump assemblies. It will be further understood that the pumping system 100 may include additional components not necessary for the present description.

Each of the remote assemblies 106 preferably includes a self-propelled, remotely-operated equipment deployment vehicle 118 and cargo 120. The cargo 120 may include any tool, equipment or other cargo that is intended to be deployed or positioned downhole, such as, for example, electric submersible pumping units, tubing, tubing connectors, tubing adaptors, sensor packages, gas separators, perforating tools, and injection pumps. The weight of the cargo 120 holds the equipment deployment vehicle 118 to the surface of the wellbore 102. The relatively small diameter of the wellbore 102 encourages an arc of tight contact between the wellbore 102 and the articulated surfaces of the equipment deployment vehicle 118.

Although the preferred embodiments are not so limited, FIG. 2 depicts three remote assemblies 106*a*, 106*b* and 106*c*. Remote assemblies 106*a* and 106*c* include remote pump assemblies 122 and remote assembly 106*b* includes a sensor package 124.

In the embodiment depicted in FIG. 2, the remote assemblies 106 are preferably connected to each other and to the base assembly 104 with an umbilical 126. The umbilical 126 provides a flexible conduit for pumped fluids from the remote assemblies 106 and preferably also includes power and signal cables to provide power and telemetry between the base assembly 104 and the remote assemblies 106. In certain applications, the umbilical 126 is not configured to conduct fluids and the movement of fluids is accomplished by simply pumping through the wellbore 102*b*.

Figure 3:
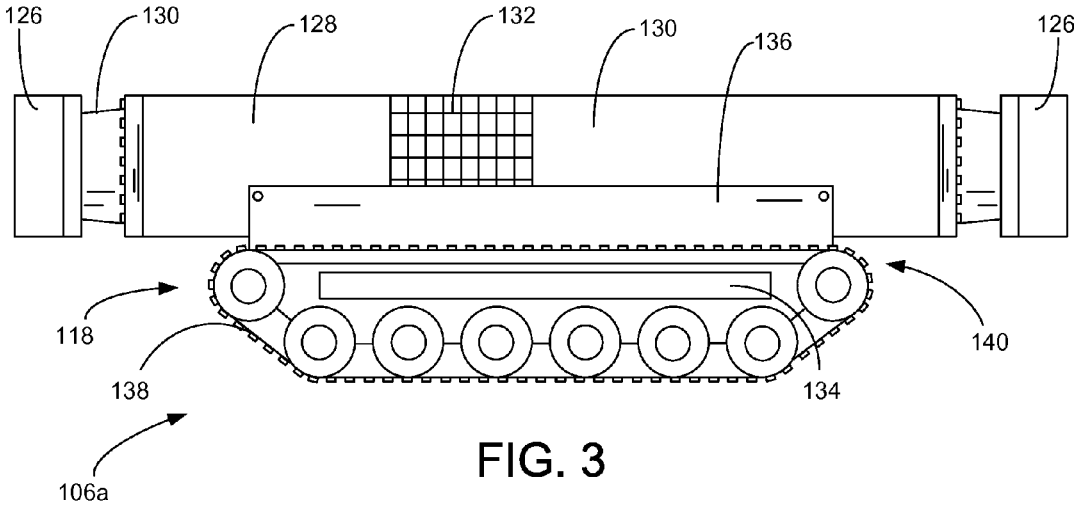
FIG. 3 is a side view of an equipment deployment vehicle constructed in accordance with a second preferred embodiment.

Turning to FIG. 3, shown therein is a side view of the remote pump assembly 122 constructed in accordance with a preferred embodiment. Each remote pump assembly 122 includes a remote pump 128 and a remote motor 130. The remote pump 128 and remote motor 130 are supported on the equipment deployment vehicle 118. The remote pump 128 is preferably configured as a multistage centrifugal pump that is driven by a common shaft (not shown) connected to the remote motor 130. The remote pump 128 includes an intake 132 and a discharge 134. When energized by power supplied through the umbilical 126, the remote motor 130 rotates the shaft and turns the impellers of the remote pump 128. Fluid drawn through the intake 132 is pressurized and expelled through the discharge 134 to downstream components of the electric submersible pumping system 100.

Although the remote pump 128 is configured as a centrifugal pump in preferred embodiments, it will be appreciated that the remote pump 128 may include positive displacement pumps, gear pumps, piston pumps, screw pumps and other fluid moving devices. Furthermore, although the remote motor 130 is preferably configured as an electric motor, it will be appreciated that the remote motor 130 may also be configured as a hydraulic motor, pneumatic motor or other prime move configured to drive the remote pump 128.

The equipment deployment vehicle 118 is generally configured and designed to deliver, deploy or position tools and other equipment within a deviated wellbore. The equipment deployment vehicle 118 preferably includes a cargo frame 136, an electric drive motor 138 and a mobility assembly 140. The mobility assembly 140 can be configured to move and change the direction of movement of the equipment deployment vehicle 118. In the first preferred embodiment depicted in FIGS. 2 and 3, the equipment deployment vehicle 118 is configured as a self-propelled, remote-controlled vehicle that includes an "active" mobility assembly 140.

The active mobility assembly 140 includes a pair of endless tracks 142 that are controllably driven by the electric drive motor 138. The tracks 142 preferably include an aggressively treaded exterior surface for efficiently moving the equipment deployment vehicle 118 and cargo 120 along the deviated section 102*b*. In a variation of the first preferred embodiment, the active mobility assembly 140 is replaced with a passive mobility assembly in which the tracks 142 are not driven by the electric motor 138. The use of the passive mobility assembly may be desirable in situations in which the equipment deployment vehicle 118 is connected to and moved by a second equipment deployment vehicle 118.

Figure 4:
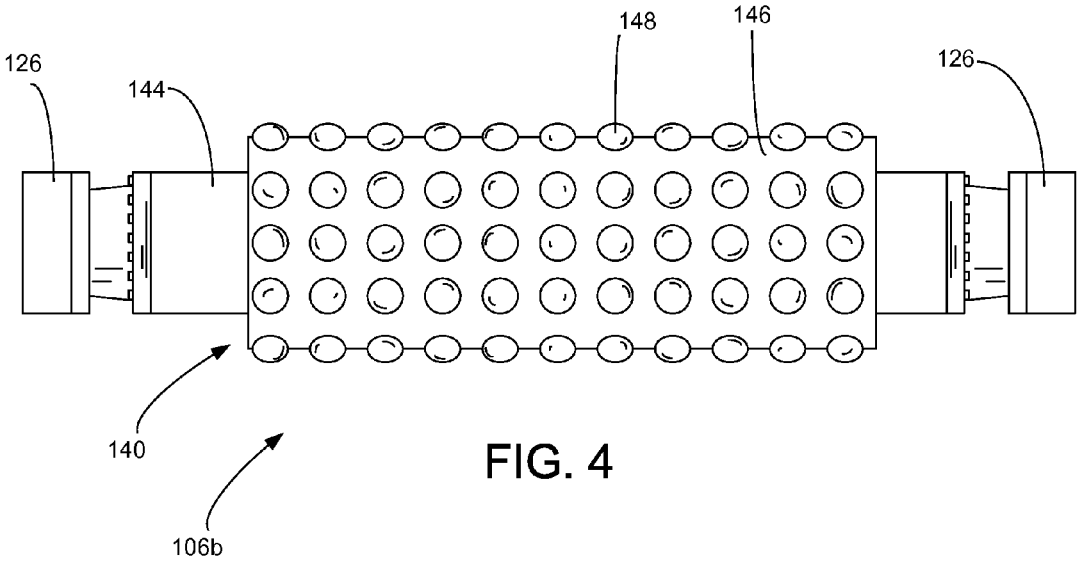
FIG. 4 is a side view of an equipment deployment vehicle constructed in accordance with a first preferred embodiment.

Turning to FIG. 4, shown therein is a side view of the remote assembly 106*b*. The remote assembly 106*b* includes a sensor package 144 supported by the equipment deployment vehicle 118. The sensor package 144 is configured to measure environmental and production characteristics in the deviated section 102*b* of the wellbore 102. In a particularly preferred embodiment, the sensor package 144 provides real-time information about flowrate, temperature, pressure and gas content to the surface facilities 108 through a wired or wireless connection. The ability to provide real-time information about conditions in the deviated section 102*b* of the wellbore 102 enables the optimization of the operation of the base and remote assemblies 104, 106.

As depicted in FIG. 4, the equipment deployment vehicle 118 is preferably configured such that the mobility assembly 140 includes a cylindrical sleeve 146 that surrounds the cargo frame 136. The sleeve 146 includes a plurality of ball bearings 148 that extend through the sleeve 146. In a particularly preferred variation, the ball bearings 148 and sleeve 146 constitute a passive mobility assembly 140 that allows the cargo 120 to be pulled or pushed along the deviated wellbore 102*b*. The ball bearings 148 provide a low-friction mechanism for supporting and moving the cargo 120. Additionally, the cylindrical sleeve 146 and ball bearings 148 can be configured such that the equipment deployment vehicle 118 functions as a mobile centralizer to position the cargo 120 within the center of the wellbore 102.

With reference again to FIG. 2, it will be noted that during installation of the electric submersible pumping system 100, the remote assemblies 106 are driven into strategic locations in the deviated section 102*b* of the wellbore 102. The base assembly 104 can be positioned at a desired depth in the vertical section 102*a*. In a first preferred embodiment, the remote assemblies 106 are inserted into the wellbore with the base assembly 104, separated from the base assembly 104 and then driven into desired locations within the deviated section 102*b*. In a second preferred embodiment, the remote assemblies 106 are loaded into the wellbore 102 first and strategically positioned within the deviated section 102*b* before the base assembly 104 is deployed into the vertical section 102*b*.

Once the remote assemblies 106 and base assembly 104 are properly positioned, the remote assemblies 106 can be selectively operated to move wellbore fluids out of the deviated wellbore 102*b* into the vertical wellbore 102*a*, where the fluids can then be pumped to the surface by the base assembly 104. The strategic placement of multiple pumping units along the lateral deviated section 102*b* of the wellbore 102 produces a more consistent flow from the wellbore 102, reduced backpressure from the vertical fluid head. The production of fluid from the wellbore can be optimized by controlling the position and operating characteristics of the base assembly 104 and remote assemblies 106 on an independent basis. For example, it may be desirable to increase the output of one or more of the remote assemblies 106 while decreasing the output of the base assembly 104.

Figure 5:
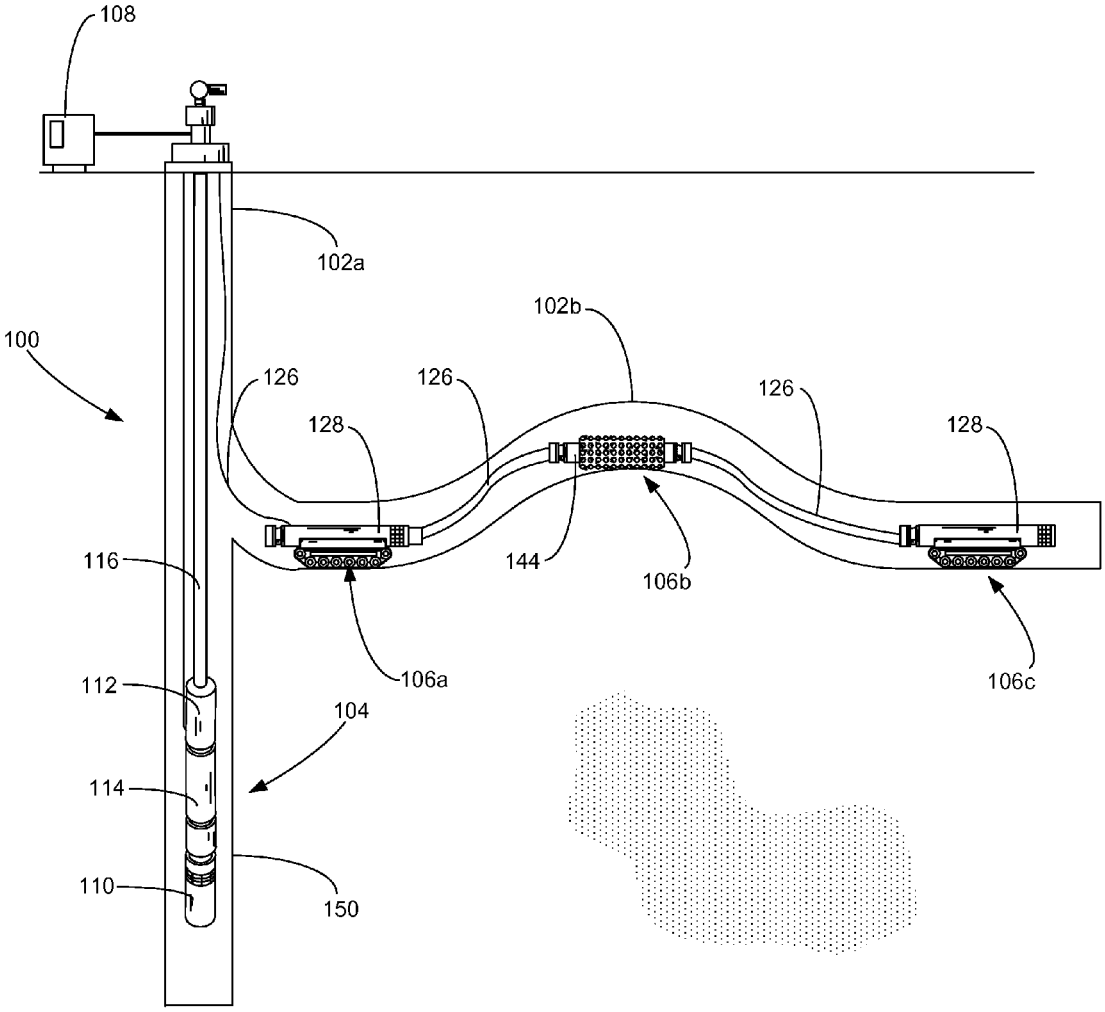
FIG. 5 is an elevation view of an electric submersible pumping system constructed and deployed in accordance with a second preferred embodiment deployed in a deviated wellbore.

Turning to FIG. 5, shown therein is an alternate preferred embodiment in which the vertical section 102*a* of the wellbore 102 includes a sump section 150 below the point at which the deviated section 102*b* intersects the vertical section 102*a*. In the preferred embodiment depicted in FIG. 5, the base assembly 104 is positioned within the sump section 150 of the wellbore 102 and the remote assemblies 106 are positioned within the deviated section 102*b*. The base assembly 104 is preferably configured such that the pump assembly 110 is positioned below the motor assembly 112. In this way, fluids drawn into the pump assembly 110 from above the base assembly 104 pass over the motor assembly 112 to provide convective cooling.

During operation, the remote pumps 128 force fluids from the deviated section 102*b* into the vertical section 102*a*. The fluids fall to the sump section 150 of the wellbore, where they are forced to the surface by the base assembly 104. It will be noted that the umbilical 126 used to connect the remote assembly 106*a* to the surface facilities 108 does not include a conduit for pumped fluids. In this variation, the umbilical 126 only provides power and telemetry between the surface facilities 108 and the remote assembly 106*a*. The remote pump 128 on the remote assembly 106*a* simply pushes fluids from the deviated section 102*b* into the vertical section 102.

Figure 6:
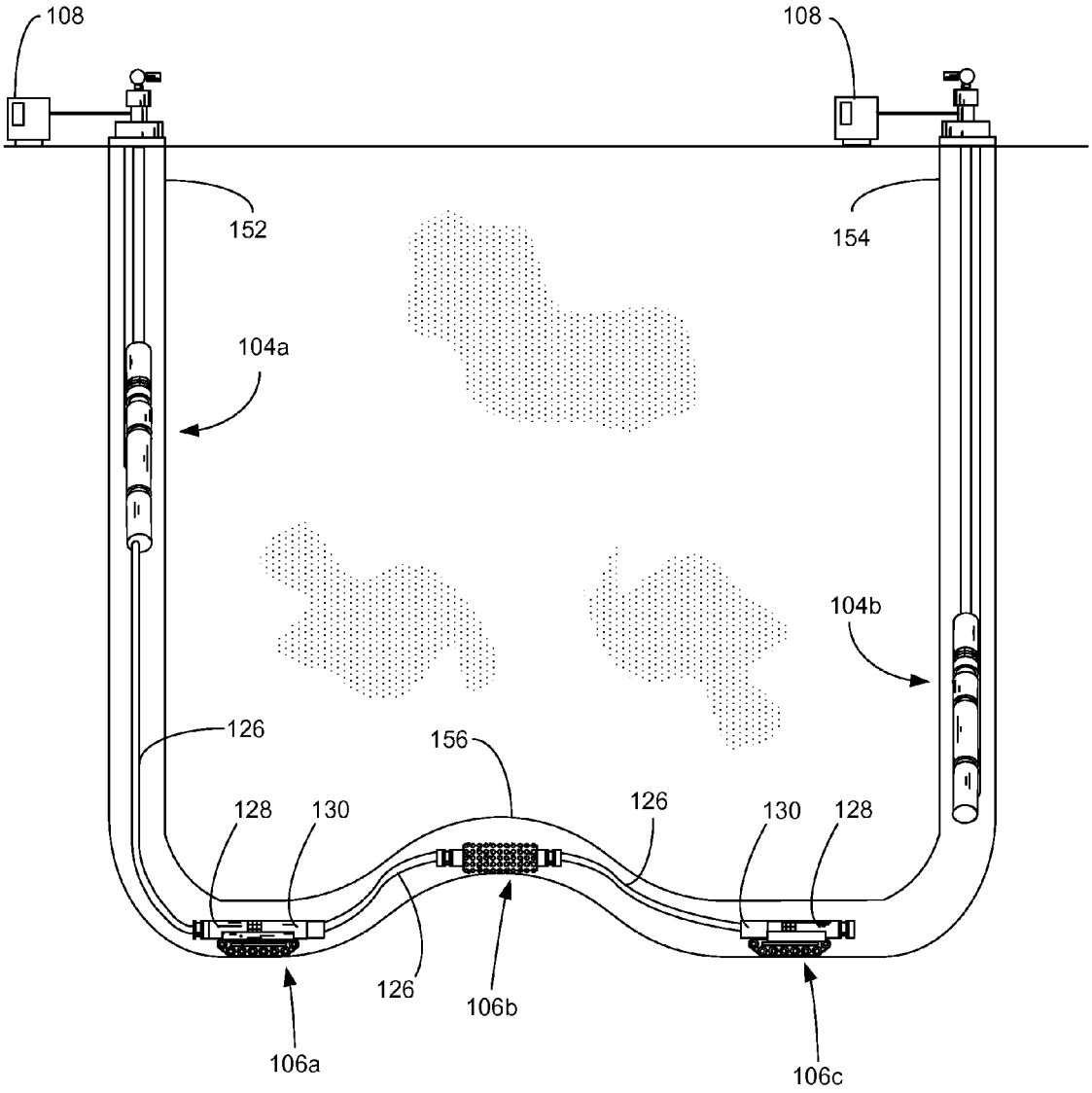
FIG. 6 is an elevation view of an electric submersible pumping system constructed in accordance with a third preferred embodiment deployed in a deviated wellbore.

Turning to FIG. 6, shown therein is yet another alternate preferred embodiment in which the wellbore 102 includes a first vertical section 152 and a second vertical section 154 that are connected by a common lateral section 156. In this embodiment, the electric submersible pumping system 100 includes two base assemblies 104*a*, 104*b* in the first and second vertical sections 152, 154 and a series of remote assemblies 106 in the lateral section 156. In this embodiment, the remote assemblies 106 are provided with two extraction points through the first and second vertical sections 152, 154. The remote assemblies 106 are preferably connected to the first base assembly 104*a* with the umbilical 126. In a particularly preferred embodiment, the remote assembly 106*c* is configured to pump fluids toward the second vertical section 154 and the remote assembly 106*a* is configured to pump fluids toward the first vertical section 152.

The remote assemblies 106 and the base assemblies 104*a*, 104*b* can be independently controlled to optimize the recovery of fluids from the producing formations of the reservoir. In particular, the base assemblies 104 and remote assemblies 106 can be controlled such that each assembly is only operated during optimal pumping periods.

Figure 7:
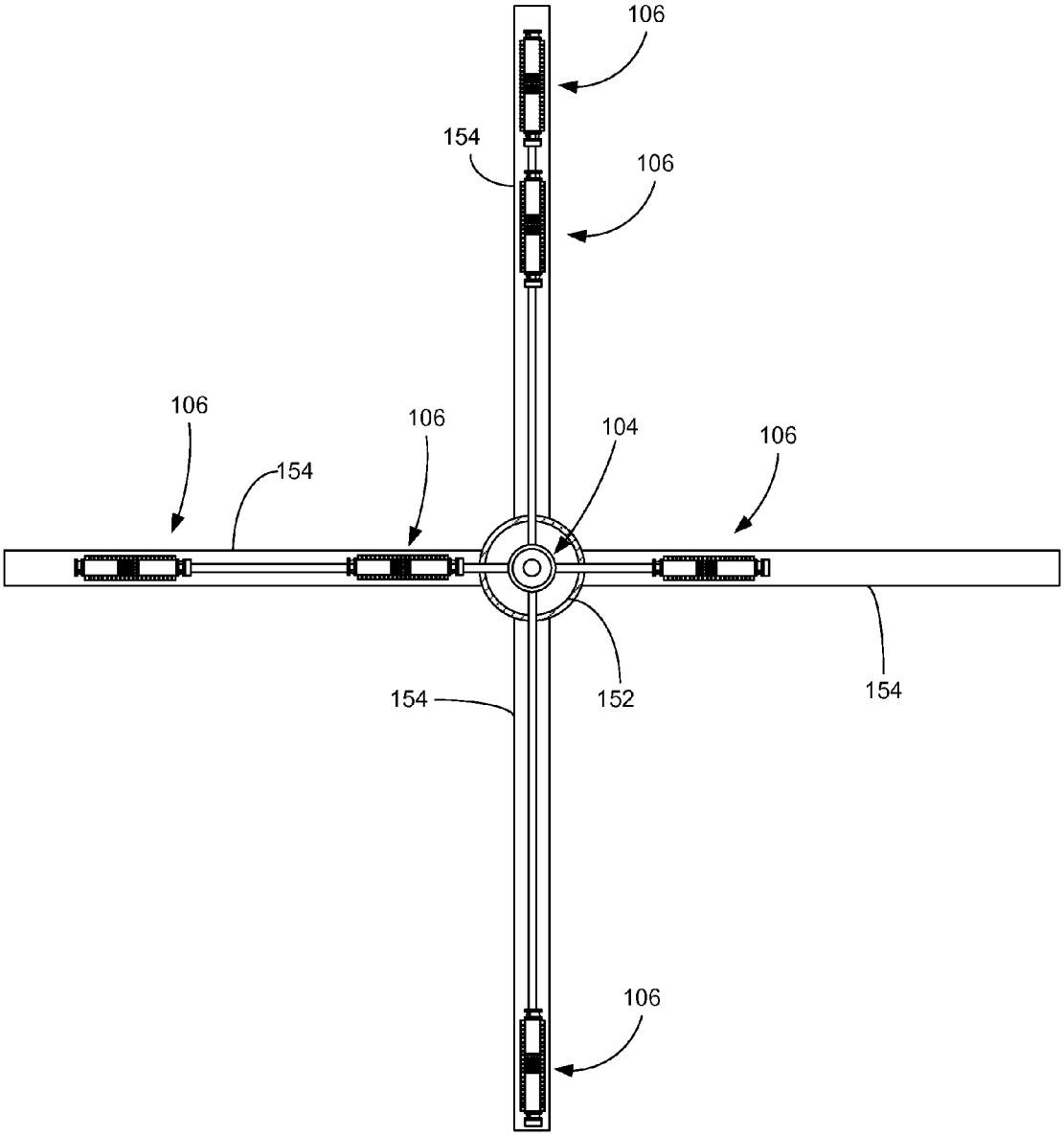
FIG. 7 is a top view of an electric submersible pumping system constructed in accordance with a fourth preferred embodiment.

Turning now to FIG. 7, shown therein is a top view of the electric submersible pumping system 100 installed in another preferred embodiment. As illustrated in FIG. 7, the wellbore 102 includes a single vertical shaft 152 and a plurality of laterals 154 extending outward therefrom. The laterals 154 may extend from the vertical shaft 152 at the same of different depths. A base assembly 104 is installed in the vertical shaft 152 and one or more remote assemblies 106 are strategically installed in each of the laterals 154. The number and placement of the remote assemblies 106 in each lateral 154 will depend on the characteristics of the particular lateral 154. The remote assemblies 154 are preferably driven under independent power into the laterals 154. In this configuration, the strategically placed remote assemblies 106 drive fluid out of the laterals 154 into the common vertical shaft 152.

It will be appreciated that the depictions of the electric submersible pumping system 100 in FIGS. 2 and 5-7 are merely preferred embodiments and the scope of the present invention is not so limited. In particular, it may be desirable to construct the electric submersible pumping system 100 such that it includes fewer, greater or different remote assemblies 106. In certain applications, it may be desirable to include additional base assemblies 104, but in other applications it may be desirable to omit the base assembly 104 entirely. Each of these alternatives is contemplated as falling within the scope of presently preferred embodiments. It will be appreciated by those of skill in the art that the use of multiple remote assemblies 106 provides a redundancy that is not found in traditional single pump installations.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pumping system for use in recovering fluids from a wellbore, the electric submersible pumping system comprising:

a base assembly, wherein the base assembly is connected to production tubing, and wherein the base assembly comprises:

an electric motor; and a pump assembly driven by the electric motor and connected to the production tubing; and a remote assembly spaced apart from the base assembly and connected to the base assembly with an umbilical, wherein the remote assembly comprises:

a remote motor;

a remote pump driven by the remote motor; and an equipment deployment vehicle and wherein the remote motor and remote pump are supported by the equipment deployment vehicle.

2. The electric submersible pumping system of claim 1, wherein the wellbore comprises a vertical section and a lateral portion and wherein the base assembly is positioned within the vertical section and the remote assembly is positioned in the lateral portion.

3. The electric submersible pumping system of claim 1, wherein the equipment deployment vehicle comprises:

a drive motor; and a mobility assembly.

4. The electric submersible pumping system of claim 3, wherein the equipment deployment vehicle is self-propelled and remotely-controlled.

5. The electric submersible pumping system of claim 1 further comprising surface facilities and wherein the remote assembly is connected to the surface facilities with the umbilical.

6. A distributed artificial lift system for use in a wellbore that includes at least a first lateral, a second lateral and at least one vertical section, wherein the first lateral is connected to the second lateral only through the vertical section, the distributed artificial lift system comprising:

a first remote assembly positioned within the first lateral, wherein first the remote assembly comprises:

an equipment deployment vehicle; and cargo, wherein the cargo of the first remote assembly comprises:

a remote motor; and a remote pump driven by the remote motor; and a second remote assembly positioned within the second lateral, wherein the second remote assembly comprises:

an equipment deployment vehicle; and cargo, wherein the cargo is selected from the group consisting of electric remote pumping units, tubing, tubing connectors, tubing adaptors, sensor packages, gas separators, perforating tools, and injection pumps.

7. The distributed artificial lift system of claim 6, wherein the equipment deployment vehicle of the first remote assembly comprises a drive motor and a mobility assembly driven by the drive motor.

8. A distributed artificial lift system for use in a wellbore that includes at least a first lateral, a second lateral and at least one vertical section, wherein the first lateral is connected to the second lateral only through the vertical section, the distributed artificial lift system comprising:

a first remote assembly positioned within the first lateral, wherein first the remote assembly comprises:

an equipment deployment vehicle; and cargo, wherein the cargo is selected from the group consisting of electric remote pumping units, tubing, tubing connectors, tubing adaptors, sensor packages, gas separators, perforating tools, and injection pumps; and a second remote assembly positioned within the second lateral, wherein the second remote assembly comprises:

an equipment deployment vehicle; and cargo, wherein the cargo is selected from the group consisting of electric remote pumping units, tubing, tubing connectors, tubing adaptors, sensor packages, gas separators, perforating tools, and injection pumps; and wherein the equipment deployment vehicles of the first remote assembly and second remote assembly are each remotely-controlled and self-propelled.

9. The distributed artificial lift system of claim 8 further comprising a base assembly positioned within the vertical section, wherein the base assembly comprises:

an electric motor; and a pump assembly driven by the electric motor.

10. The distributed artificial lift system of claim 9, wherein the first and second remote assemblies each comprise:

a remote motor; and a remote pump driven by the remote motor.

11. A method for recovering fluids from a subterranean reservoir through a wellbore, wherein the wellbore includes a first vertical and a first lateral connected to the first vertical, the method comprising the steps of:

providing a first base assembly, wherein the first base assembly comprises a motor assembly and a pump assembly driven by the motor assembly;

providing a first remote assembly connected to the first base assembly with an umbilical, wherein the first remote assembly comprises an equipment deployment vehicle and a remote pump supported by the equipment deployment vehicle;

lowering the first base assembly to a desired location in the first vertical;

lowering the first remote assembly through the first vertical of the wellbore to the first lateral;

driving the equipment deployment vehicle of the first remote assembly to a desired location within the first lateral;

activating the remote pump of the first remote assembly to remove fluids from the first lateral; and activating the pump assembly of the first base assembly to remove fluids from the first vertical.

12. The method of claim 11, wherein the step of activating the remote pump of the first remote assembly further comprises the step of activating the remote pump of the first remote assembly to remove fluids from the first lateral to the first vertical.

13. The method of claim 11, wherein the first vertical further comprises a sump section below the first lateral and the step of lowering the base assembly further comprises lowering the base assembly into the sump section of the first vertical.

14. The method of claim 11, wherein the wellbore further comprises a second lateral connected to the first vertical and wherein the method further comprises:

providing a second remote assembly, wherein the second remote assembly comprises an equipment deployment vehicle and a remote pump supported by the equipment deployment vehicle;

lowering the second remote assembly through the first vertical of the wellbore to the second lateral;

driving the equipment deployment vehicle of the second remote assembly to a desired location within the second lateral; and activating the remote pump of the second remote assembly to remove fluids from the second lateral.

15. The method of claim 11, wherein the wellbore further comprises a second vertical connected to the first lateral and wherein the method further comprises:

providing a second base assembly, wherein the second base assembly comprises a motor assembly and a pump assembly driven by the motor assembly;

lowering the second base assembly to a desired location in the second vertical; and activating the pump assembly of the second base assembly to remove fluids from the second vertical.

16. The method of claim 15, wherein the wellbore further comprises a second lateral connected to the first vertical and wherein the method further comprises:

providing a second remote assembly, wherein the second remote assembly comprises an equipment deployment vehicle and a remote pump supported by the equipment deployment vehicle;

lowering the second remote assembly through the first vertical of the wellbore to the second lateral;

driving the equipment deployment vehicle of the second remote assembly to a desired location within the second lateral; and activating the remote pump of the second remote assembly to remove fluids from the second lateral into the second vertical.

* * * * *